US006314770B1

(12) United States Patent
Bartalucci et al.

(10) Patent No.: US 6,314,770 B1
(45) Date of Patent: Nov. 13, 2001

(54) PLANT AND METHOD FOR SUPPLYING MACHINES WITH DYES FOR THE CONTINUOUS DYEING OF TEXTILE MATERIALS

(75) Inventors: Moreno Bartalucci, Florence; Mario Scatizzi, Pistoia; Mauro Anguillesi, Prato, all of (IT)

(73) Assignee: Tecnorama S.r.l. (IT)

( * ) Notice: Subject to any disclaimer, the term of this patent is extended or adjusted under 35 U.S.C. 154(b) by 0 days.

(21) Appl. No.: 09/262,636

(22) Filed: Mar. 4, 1999

(30) Foreign Application Priority Data

Jul. 27, 1998 (IT) ..... FI98A0176

(51) Int. Cl.[7] ..... D06B 1/02

(52) U.S. Cl. ..... 68/13 R; 68/207; 68/205 R; 366/160.1

(58) Field of Search ..... 68/17 R, 207, 68/205 R, 13 R; 366/29, 37, 160.1, 20, 16, 17, 18, 19, 21; 8/158

(56) References Cited

U.S. PATENT DOCUMENTS

| | | | | |
|---|---|---|---|---|
| 2,979,066 | * | 4/1961 | Christie | 68/205 R |
| 4,578,965 | * | 4/1986 | Brossman | 68/205 R |
| 4,632,147 | * | 12/1986 | Whaley . | |
| 4,691,850 | | 9/1987 | Kirschmann et al. . | |
| 5,109,682 | * | 5/1992 | Toschi et al. | 68/205 R |
| 5,208,930 | * | 5/1993 | Chabard . | |
| 5,590,976 | * | 1/1997 | Kilheffer et al. . | |
| 5,746,238 | | 5/1998 | Brady et al. . | |
| 6,050,282 | * | 4/2000 | Whaley . | |

FOREIGN PATENT DOCUMENTS

| | | | |
|---|---|---|---|
| 24 56 250 | | 8/1976 | (DE) . |
| 0 203 182 B1 | | 3/1990 | (EP) . |
| 0 503 248 A1 | | 1/1992 | (EP) . |
| 2064603 | * | 6/1981 | (GB) . |
| WO 86/03235 | | 6/1986 | (WO) . |
| WO 96/33934 | | 10/1996 | (WO) . |

* cited by examiner

*Primary Examiner*—Frankie L. Stinson
(74) *Attorney, Agent, or Firm*—McGlew and Tuttle, P.C.

(57) ABSTRACT

Plant for supplying machines with dyes for the continuous dyeing of textile materials, comprising means for preparing a dyeing bath, the dyeing bath consisting of a mixture of dyeing products, chemicals and/or auxiliary products in aqueous solution, said means comprising an apparatus (12, 13, 14) for the preparation of dyeing solutions in preset strengths starting from said dyeing products, a plurality of tanks (1) for said chemicals and/or auxiliary products to which one or more pumps (6; 10) are associated for the removal of respective products, and an array of conduits for water supply. The outlets of said means are connected to a manifold (26) downstream of which is a dyeing machine (M) to be supplied, and to which manifold (26) means (27) are associated for mixing the products arriving thereat: the means for the preparation of the dyeing bath being associated to a programmable electronic unit (U). (FIG. 2).

14 Claims, 4 Drawing Sheets

PLANT AND METHOD FOR SUPPLYING MACHINES WITH DYES FOR THE CONTINUOUS DYEING OF TEXTILE MATERIALS

FIELD OF THE INVENTION

The present invention refers to a plant and a method for supplying machines with dyes for the continuous dyeing of textile materials.

BACKGROUND OF THE INVENTION

It is well known to those skilled in the art that the continuous dyeing of textile materials such as carpets, fabrics and unwoven materials, is operated by deeping these materials in a selected dyeing bath and ensuring a continuous and constant level of the bath within the same dyeing machine which includes the means for feeding the material under treatment while the bath is supplied with dye. The dyeing bath consists of a solution comprising a set of components such as chemicals, auxiliary and dyeing products, as well as water, in proportions corresponding to the formulations or recipes which are each time chosen, the same bath being prepared in suitable containers outside the machine which is continuously supplyed therewith.

The solutions to be fed to the dyeing machine are prepared mostly manually, which is possibly a cause for some inaccuracy in the metering of components. This may heavily reduce the possibility of having baths comprising solutions with steady and periodically restored characteristics, contrary to what is normally required for carrying out this type of treatment.

An automated plant for the preparation of solutions intended for dyeing machines is disclosed in the European Patent No. 203182. This plant is so constructed as to allow the flow of dyeing solutions from a plurality of stocking tanks, to be diverted among a plurality of different outlets. Besides, associated to each of said tanks is a close loop line for continuously recirculating the relevant solutions. However, dispite the structural and operational complexity of this known plant, it is not entirely excluded that the solutions circulating within the relevant conduits may become contaminated, before being fed to the machine using them, as they enter in contact with solutions of different titre circulating within the same conduits.

SUMMARY AND OBJECTS OF THE INVENTION

The main object of the present invention is to provide a plant allowing the fully automatic preparation and feeding of baths to dyeing machines with no possibility for the solutions to be contaminated before being delivered to the machine using them.

This result has been achieved, according to the invention, by providing an apparatus or plant having a plurality of dye tanks. A metering/dissolving device is connected to the plurality of dye tanks for preparing different dye solutions in each of the plurality of dye tanks. The dye solutions are prepared from dye products in the form of powders and/or granules. A plurality of primary auxiliary tanks are provided for holding chemical and auxiliary solutions that may be desired in the preparation of the dye solutions. An auxiliary manifold selectively receives the chemical and auxiliary solutions from the primary auxiliary tanks and then feeds the combination of chemical and auxiliary solutions to auxiliary tanks which include motor driven stirrers. The auxiliary manifold has a connection for receiving washing liquid to clean the auxiliary manifold once the proper amounts of chemical and auxiliary solutions have been selected and transferred to the auxiliary tanks. The washing liquid used is one of the ingredients of the dye solution and the washing liquid used to clean the auxiliary manifold is also fed to the auxiliary tanks.

A plurality of pumps are connected to each of the dye and auxiliary tanks for removing a respective solution from a respective tank. A main manifold is connected to a plurality of pumps and receives a solution from the plurality of pumps. A mixer arranged in the manifold mixes the solutions in the manifold and from there the mixed solution is fed to a dye machine which consumes the dye. A programable control unit is connected to the pumps and the metering/dissolving device in order to selectively, continuously, and automatically prepare and supply dye to the machine consuming the dye.

The present invention makes it possible to always ensuring, in a fully automatic way, the most accurate dyeing of textile materials under work, without any contamination of the solutions circulating within the conduits upstream of means provided for ultimately mixing the same solutions. Moreover, as the final mixing of the solutions to be fed to the dyeing machine is operated just upstream of the latter, it is possible to supply the same machine with different solutions which exhibit long lasting characteristics of immiscibility and which, accordingly, cannot be stored being mixed beforehand. It is also possible to achieve a significant reduction of electric power, thanks to the fact that the water used for washing the conduits and the means for dissolving the powdered and/or granulated dyes may be used also for achieving the final titre of the solutions preparared in the respective tanks. The plant according to the invention is of relatively simple construction and is able to accomodate a high number of tanks for dye solutions, chemicals and auxiliary products at different strengths thereby widening its production capacity.

These and other advantages and characteristics of the invention will be best understood by anyone skilled in the art from a reading of the following description in conjunction with the attached drawings given as a practical exemplification of the invention, but not to be considered in a limitative sense, with

DESCRIPTION OF THE PREFERRED EMBODIMENT

Figure 1:
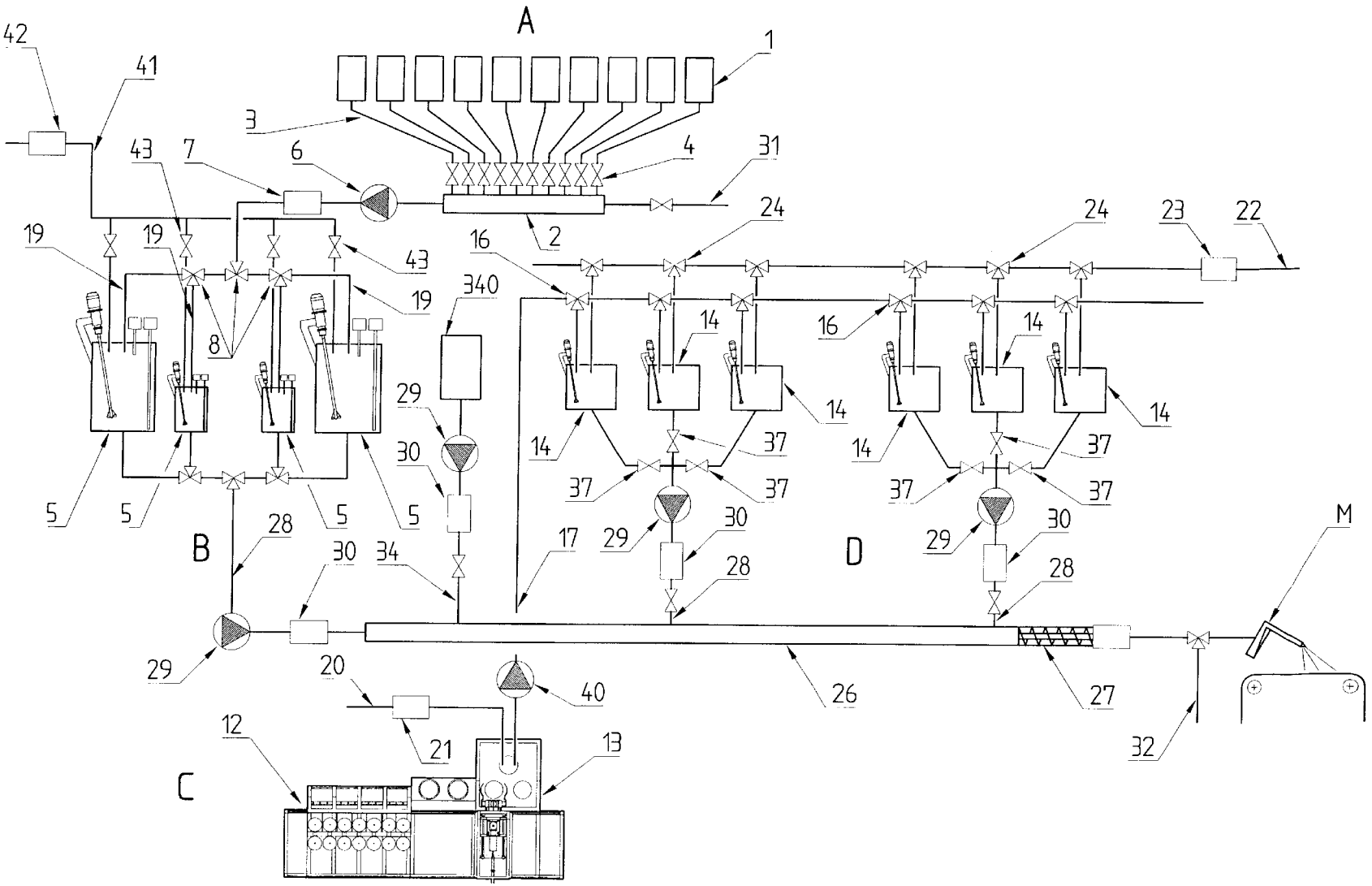
FIG. 1 shows schematically a possible embodiment of the plant according to the invention.
Figure 2:
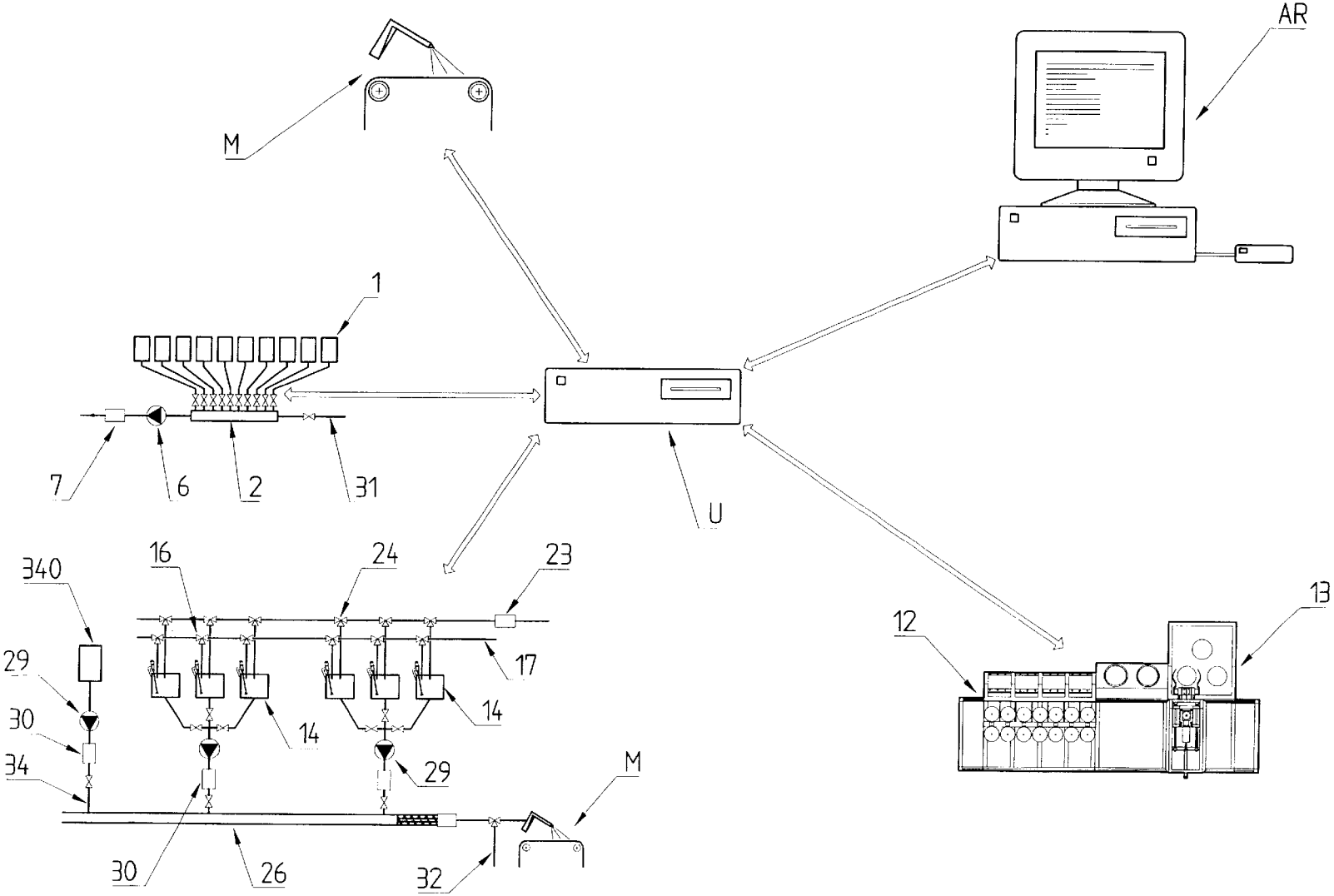
FIG. 2 shows schematically a system for controlling and operating the plant of FIG. 1.

Reduced to its basic structure, and reference being made to the figures of the attached drawings, a plant according to the invention comprises in combination:

a plurality of tanks (1) disposed in a first station (A) for stocking chemicals and auxiliary products in a liquid state: each of said tanks (1) exhibiting an outlet conduit (3) on which a valve (4) is inserted whose outlet is connected to a common manifold (2) collecting the products discharged from said tanks (1), said manifold (2) being also associated to a conduit (31) admitting water for the washing of same manifold and feeding a positive-displacement pump (6) provided with relevant flowmeter (7);

a plurality of mixers (5), provided in a second station (B) located downstream of said first station (A), which are supplied with the products exiting from the manifold (2) via corresponding conduits (19) which branch off from corresponding three-way valves (8) to which the products exiting from the pump (6) are made to arrive, the mixers (5) being also associated to a water-feeding line (41) with relevant meter (42) and shut-off valves (43); said mixers being schematically represented in the figures of the attached drawings. In particular, the figures show the tanks containing the liquid products coming from the manifold (2) and relevant motor-driven stirrers with inclined axes and level gauges;

means or device (12, 13) in a third station (C) for metering and dissolving the powdered or granulated dyes for the obtainment of dyeing solutions in preset strengths to be fed to corresponding containers (14) of a fourth station (D) via a conduit (17) provided with a plurality of three-way valves (16) from each of which a conduit branches out for feeeding each of said containers (14), also leading to same containers being a plurality of conduits which admit water coming from a corresponding line (22) provided with relevant flowmeter (23) and a three-way valve (24) for each one of containers (14): the said means (13) for dissolving the powdered or granulated dye being supplied with the necessary water via a corresponding conduit (20) with flowmeter (21) and delivering the thus obtained dyeing solutions by means of a positive-displacement pump (40) to which the conduit (17) is connected; the containers (14) of station (D) being schematically represented likewise the containers (5) of station (B). In particular, the figures show schematically the said containers, stirrers and level gauges associated thereto;

a manifold (26) inside which a screw feeder (27) is installed for simultaneously feeding and mixing the incoming liquid products, which manifold (26) receives the liquids coming out from the containers (5) of said second station (B) and from containers (14) of said fourth station (D), and may also receives water from a tank (340) provided with respective outlet conduit (34) connected to the manifold (26): The supply of manifold-mixer (26) with liquids exiting from said stations (B) and (D)

and delivered to corresponding outlet conduits (28)—and with the water from conduit (34) being ensured by corresponding positive-displacement pumps (29) to which respective flowmeters (30) are associated.

According to the embodiment illustrated by way of example in FIG. 1 of the attached drawings, the containers (5) of station (B) wherein the solutions are prepared with the products (such as organic acids, inorganic bases, surfactants, softners and/or other auxiliary products) stored inside tanks (1) of stations (A), lead to a single conduit (28) for feeding the manifold (26): upstream of the respective pump (29), the contents of containers (5) all flow into a three-way valve from which said single conduit (28) branches off. The containers (14) of station (D), wherein the dyeing solution are prepared, are disposed in groups of three units, so that each group will correspond to a colour and each unit to a preset stregth of the relevant dye. The outlet of each of the three tanks (14) of each group of station (D) exhibits a corresponding shut-off valve (37), the outlets of all said valves (37) being connected to the pump (29) of the relevant group.

Provided on the outlet of manifold (26), that is, intermediate between the manifold (26) and the machine (M), is a discharge section (32) to allow the products present therein to be drained off as necessary without reaching the machine (M). The machine (M), shown only schematically in the figures of the accompanying drawings, is of conventional type in which the material to be dyed is made to advance continuously at a preset speed as the dyeing bath is being fed. The advancement speed of the material to be dyed is adjusted, to meet specific requirements of the dyeing program in progress, by means of regulation and control units to be described later on.

The opening and closing of each valve of the plant are automatically controlled by an electronic programmable unit (U) associated to an electronic file of recipes (AR) storing the colour recipes, that is, the formulations by weight, of the solutions to be prepared within both stations (B) and (C) , as well as the water amounts to be delivered through each of the water-feeding conduits. The plant's valves are therefore of electronically and electromechanically-operate type. Associated to each pump of the plant is a corresponding encoder, not shown for the sake of clarity in the figures of the attached drawings. Each encoder is connected to said unit (U) for controlling the instantaneous velocity of the motor of each pump in the plant. Similarly, each flowmeter of the plant is connected to the programmable unit (U). It will be appreciated that said flowmeter are of a type able to generate electrical signals corresponding to the flowrates to be measured.

Figure 3:
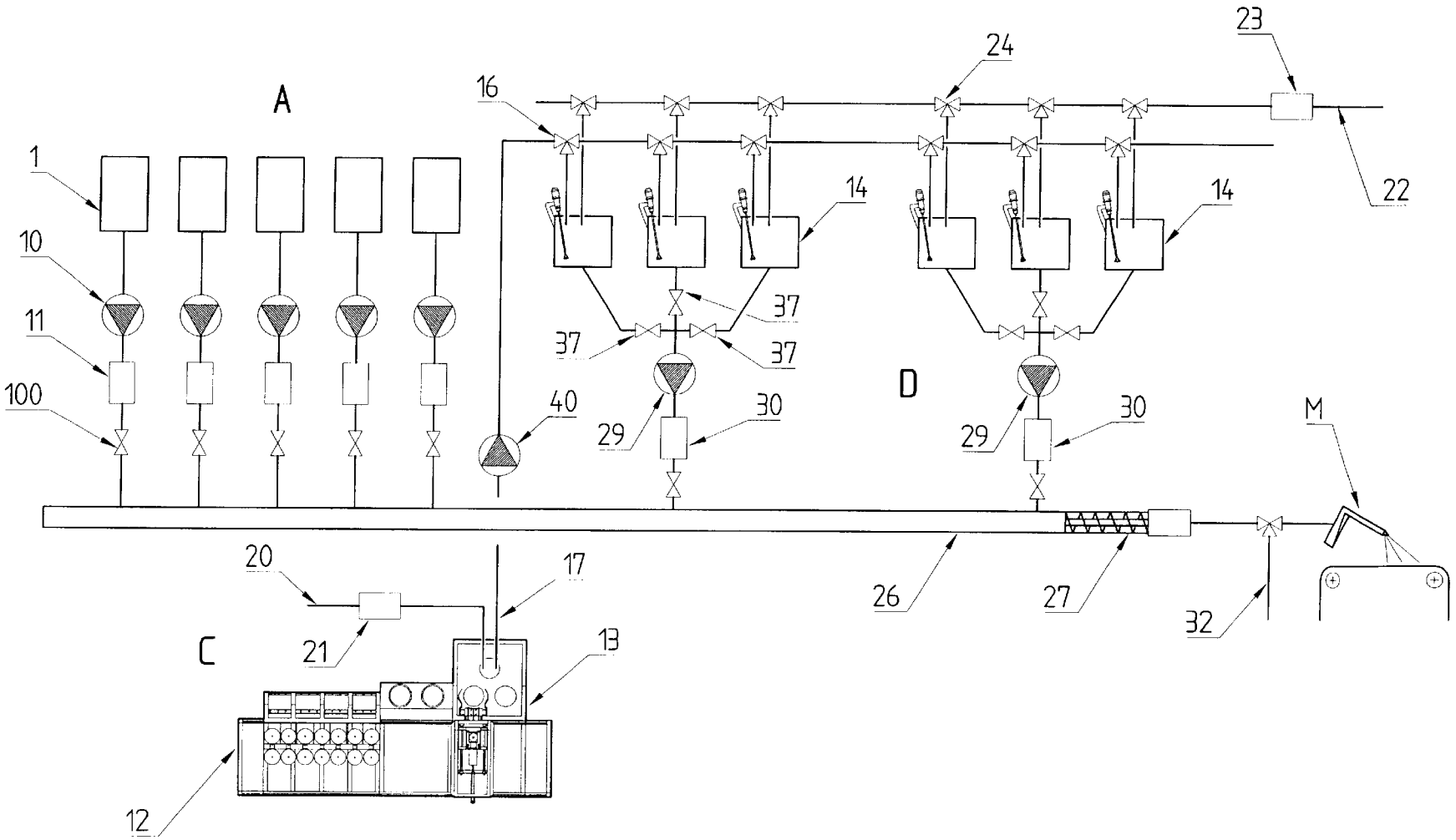
FIG. 3 shows schematically a plant according to the invention in relation to a further embodiment.
Figure 4:
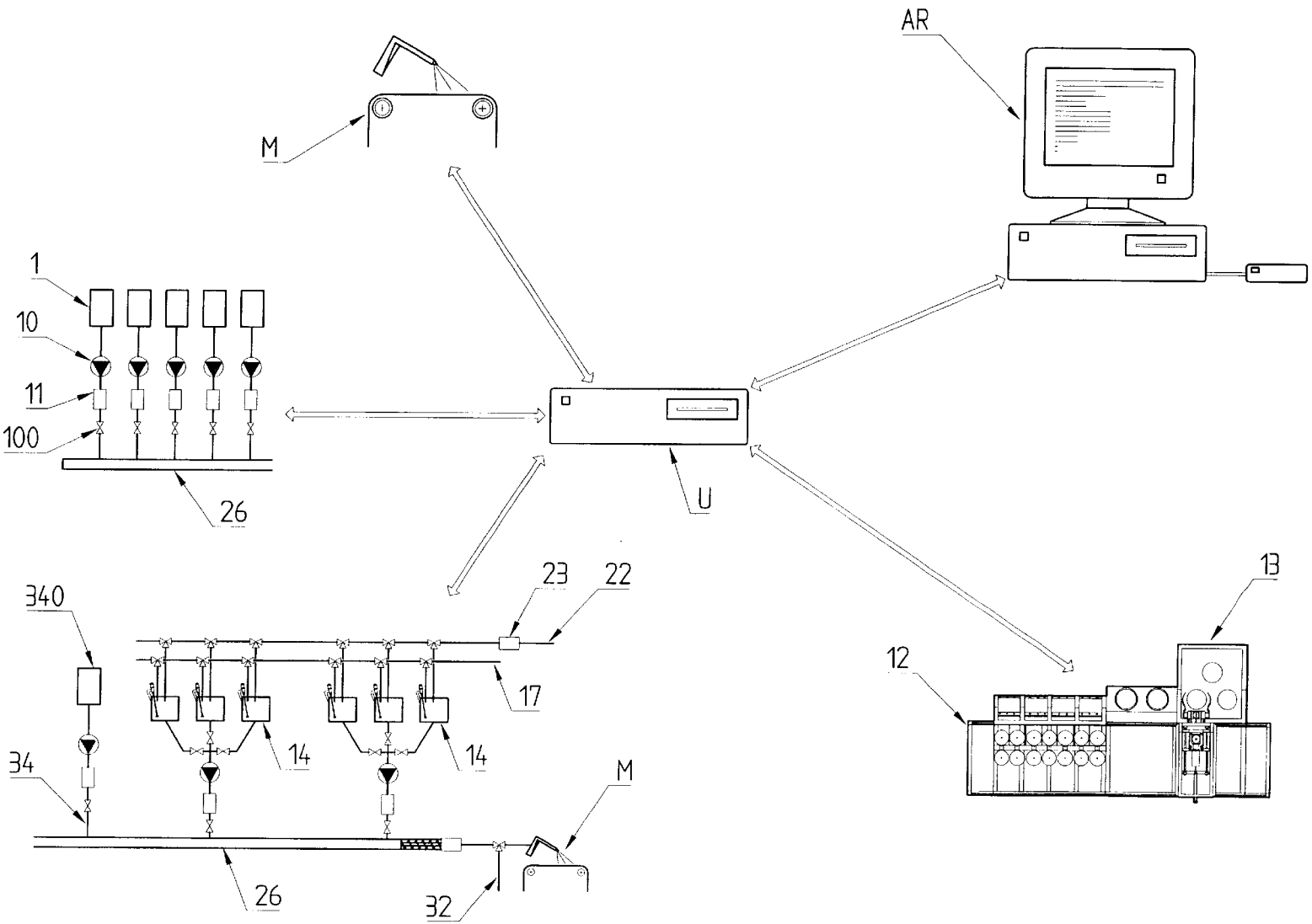
FIG. 4 shows schematically a system for controlling and operating the plant of FIG. 3.

According to a second embodiment of the present invention, and reference being made to FIGS. 3 and 4 of the accompanying drawings, the products within the tanks (1) may be delivered directly to the manifold-mixer (26, 27) instead of transiting through said pre-treatment station (B). In this case, the manifold (2) is omitted and each tank (1) is connected directly to the manifold-mixer (26, 27) via the respective outlet conduit. Fitted on each of these conduits is a corresponding positive displacement pump (10) with a flowmeter (11) and a solenoid valve (100) associated to the programmable unit (U).

The powdered or granulated dyes metering and dissolving group (12, 13) of may be of any suitable type. For example, it may be of a type disclosed in the U.S. Pat. No. 5,642,940 (corresponding to the document IT PT/95/A/002), to which reference can be made for a description in greater detail.

With reference to the embodiment illustrated in the drawing of FIG. 1—and assuming that the machine (M) is to receive a dyeing bath including solutions from both stations (B) and (D)—the operation of the plant according to the invention is as follows. As far as the preparation of solutions with auxiliary products being stored in the tanks of station (A) are concerned, these products, being selected according to a preset formulation, are fed each time to the manifold (2) through an aperture in the corresponding valves (4) and for a time predetermined in relation to the amount of same products to be removed. Afterwards, the products in question are delivered via the pump (6) to respective containers (5) in the station (B) by passing through the flowmeter (7). The transit lines of the products withdrawn each time from the tanks (1) are correspondingly configured by the valves (8) whose ways are open or closed depending on the corresponding and programmed opening and closing signals emitted by the central unit (U). Also arriving to said containers (5) is the water for washing the manifold (2): the washing of this manifold being operated—subsequently to the discharge of the products from the tanks (1) each time selected—by means of the unit (U) and in relation to the formulation to be obtained. The amount of water which arrives to the selected containers (5) through the manifold (2), is measured by the meter (7). After the selective removal of products from the tanks (1) of station (A) and the subsequent washing of manifold (2), if X indicates the amount of water necessary for preparing the required solution in the container (5) each time selected, and Y indicates the amount of water required for washing the manifold (2) and delivered into said container, the amount of water necessary to titrate the solution, as established by the program, will be equal to X-Y and will be withdrawn from the line (14). The solution thus obtained within the container (5) in question (wherein the relevant motor-driven stirrer is made to operate) is then fed to the manifold-mixer (26, 27) by the relevant pump (29) and quantified by the corresponding meter (30).

As for the preparation and delivery of the dyeing solutions, the procedure is as follows.

The solutions prepared with the powders (or granules) dissolved in the unit (13) of station (C) and with the water from the conduit (20) are fed to the tanks (14) of station (D), in a sequence preset in relation to the selected work program and which provides, in general, for each group of tanks in the station (C), for the preparation and delivery of solutions prepared with the same powders (or with the same granules) but in different strengths. The selection of the tanks (14) intended to hold the dyeing liquids is operated by the central unit (U) by activating, in a selective and programmed manner, the valves (16) of conduit (17) which connects the means (12, 13) of station (C) to the tanks (14) of station (D).

Following the preparation of each dyeing solution in the station (D), there is operated the washing of the dissolution unit (13) by the water coming from conduit (20), the amount of such water being assessed by the meter (21). The water used for washing the unit (13) is then fed to the same containers (14) which have received the last prepared solution. The amount of this washing water is taken into account, likewise in the preceding case, when preparing the final solutions in the tanks (14) of station (D). In other words, if Y' is the amount of water utilized for washing the dissolution unit (13) and X' is the amount of water necessary to obtain the solution with the required strength within the tank (14), which has received the product prepared in the dissolution unit (13), the amount of water fed to said tank (14) via the conduit (22) will be X'–Y'.

It will be evident that the electrical signals, each time generated by the flowmeters of the plant, are stored by the central unit (U) upon each washing cycle together with the relevant amounts of washing water as necessary to carry out the above computations.

All the plant's positive-displacement pumps are intended for delivering the products going through the respective lines, as well as for regulating the flow thereof. The flow adjustment is operated by controlling the speed of the respective motors. The different solutions thus fed to the manifold-mixer (26, 27) and then to the machine (M) may also be of a type unsuited for maintaining a long-term mixing condition owing to the fact that—soon after being mixed by the means associated to the manifold (26)—they are immediately utilized by the machine (M).

Moreover, the present plant makes it possible to rationalize the consumption of water in a particularly effective way.

All this brings about lower consumptions and a higher economy of the plant.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. An apparatus for supplying machines with dye, the apparatus comprising:

a plurality of dye tanks;

a metering/dissolving device connected to said plurality of dye tanks for preparing different dye solutions in each of said plurality of dye tanks from dyeing products;

a plurality of primary auxiliary tanks holding chemical and auxiliary solutions;

an auxiliary manifold selectively receiving the chemical and auxiliary solutions from said primary auxiliary tanks, said auxiliary manifold has a connection for receiving washing liquid;

a plurality of auxiliary tanks receiving a combination of the chemical and auxiliary solutions from said auxiliary manifold, said auxiliary tanks include motor driven stirrers;

a plurality of pumps, each of said plurality of pumps being connected to one of said plurality of dye and auxiliary tanks for removing a respective solution from a respective said tank;

a manifold connected to said plurality of pumps and receiving the solutions from said plurality of pumps;

a mixer arranged in said manifold and mixing the solutions in said manifold;

a programable control unit connected to said pumps and said metering/dissolving device for operating said pumps and said metering/dissolving device to prepare the dye.

2. An apparatus in accordance with claim 1, wherein:

said washing liquid is water.

3. An apparatus for continuously supplying dye, the apparatus comprising:

a plurality of dye tanks;

a metering/dissolving device connected to said plurality of dye tanks for preparing different dye solutions in each of said plurality of dye tanks from dyeing products;

a plurality of pumps, each of said plurality of pumps being connected to one of said plurality of dye tanks for removing a respective dye solution from a respective said tank;

a manifold connected to said plurality of pumps and receiving the dye solutions from said plurality of pumps;

a mixer arranged in said manifold and mixing the dye solutions in said manifold;

a programable control unit connected to said pumps and said metering/dissolving device for operating said pumps and said metering/dissolving device to selectively, continuously, and automatically prepare and supply dye from the dyeing products.

4. An apparatus in accordance with claim 3, further comprising:

a plurality of auxiliary tanks holding one of chemical and auxiliary solutions for the dye and connected to said manifold by another plurality of pumps, said programable control unit controlling said auxiliary pumps;

an array of water conduits connected to said tanks and said metering/dissolving device.

5. An apparatus in accordance with claim 4, further comprising:

a plurality of primary auxiliary tanks holding primary chemical and auxiliary solutions;

an auxiliary manifold selectively receives the primary chemical and auxiliary solutions from said primary auxiliary tanks, and delivers a combination of the primary chemical and auxiliary solutions to one of said auxiliary tanks, said auxiliary manifold having a connection for receiving washing liquid.

6. An apparatus in accordance with claim 5, wherein:

said auxiliary tanks include motor driven stirrers;

said washing liquid is water.

7. An apparatus in accordance with claim 3, wherein:

said mixer includes a screw feeder fitted in said manifold.

8. An apparatus in accordance with claim 3, wherein:

said plurality of pumps are positive displacement pumps;

a flow meter is arranged at each of said plurality of pumps;

a valve is arranged downstream of each of said flow meters.

9. An apparatus in accordance with claim 3, wherein:

said plurality of pumps flow the dyeing solutions through the manifold and cooperate with the mixer to mix the dyeing solutions.

10. An apparatus in accordance with claim 3, wherein:

said programmable control unit selectively controls the metering/dissolving device for preparation of the different dye solutions.

11. An apparatus in accordance with claim 3, further comprising:

a liquid conduit connected to said metering/dissolving device for providing a washing liquid, said programmable control unit passing the washing liquid through said metering/dissolving device and into one of said dye tanks to clean said metering/dissolving device, the washing liquid being an ingredient of the dye solution in said one tank.

12. An apparatus in accordance with claim 11, wherein:

said programmable control unit measures an amount of washing liquid used to clean said metering/dissolving device, and said programmable control unit adds a remainder amount of the washing liquid to said one tank to prepare a respective dye solution for said one tank.

13. An apparatus in accordance with claim 11, further comprising:

a liquid conduit connected to said metering/dissolving device for providing a washing liquid, said programmable control unit passing the washing liquid through said metering/dissolving device and into one of said dye tanks to clean said metering/dissolving device, the washing liquid being an ingredient of the dye solution in said one tank.

14. An apparatus in accordance with claim 13, wherein:

said programmable control unit measures an amount of washing liquid used to clean said metering/dissolving device, and said programmable control unit adds a remainder amount of the washing liquid to said one tank to prepare a respective dye solution for said one tank.

* * * * *